United States Patent [19]

Reale

[11] Patent Number: 4,646,196

[45] Date of Patent: Feb. 24, 1987

[54] CORONA GENERATING DEVICE

[75] Inventor: Louis Reale, Rochester, N.Y.

[73] Assignee: Xerox Corporation, Stamford, Conn.

[21] Appl. No.: 750,845

[22] Filed: Jul. 1, 1985

[51] Int. Cl.[4] ..... H01T 23/00

[52] U.S. Cl. ..... 361/230; 361/225; 250/324; 204/164

[58] Field of Search ..... 361/230, 229, 225; 250/324–326; 427/39, 41; 422/186.04–186.06; 204/164

[56] References Cited

U.S. PATENT DOCUMENTS

| | | | |
|---|---|---|---|
| 2,574,225 | 11/1951 | Ringk et al. | 204/38 |
| 2,813,804 | 11/1957 | Kendall et al. | 427/427 |
| 2,836,725 | 5/1958 | Vyverberg | 250/324 |
| 3,562,127 | 2/1971 | Wooten | 204/164 |
| 3,862,420 | 1/1975 | Banks et al. | 250/324 |
| 4,086,650 | 4/1978 | Davis et al. | 361/229 |
| 4,227,234 | 10/1980 | Seanor et al. | 361/229 |
| 4,265,990 | 5/1981 | Stolka et al. | 430/59 |
| 4,318,610 | 3/1982 | Grace | 355/14 D |

OTHER PUBLICATIONS

Electroless Plating Today—Dr. Edward B. Saubestre—Metal Finishing—Aug., 1962, pp. 45–49 & 52.
Research Disclosure—Nov. 1980, p. 508.
Defensive Publication—Published Nov. 4, 1975—John C. Rodda.

*Primary Examiner*—Michael L. Gellner
*Assistant Examiner*—Della J. Rutledge

[57] ABSTRACT

A corona generating device for depositing negative charge on an imaging surface carried on a conductive substrate comprises at least one elongated conductive corona discharge electrode, means to connect the electrode to a corona generating potential source, at least one element adjacent the corona discharge electrode capable of absorbing nitrogen oxide species generated once the corona generating is energized and capable of desorbing nitrogen oxide species once that electrode is not energized, the element being coated with a substantially continuous thin conductive dry film of aluminum hydroxide. In a preferred embodiment, the conductive corona discharge electrode comprises a scorotron with at least one linear array of pin coronodes where the corona control grid is coated with the substantially continuous thin conductive dry film of aluminum hydroxide.

10 Claims, 5 Drawing Figures

CORONA GENERATING DEVICE

REFERENCE TO RELATED APPLICATIONS

Reference is hereby made to copending application U.S. Ser. No. 680,867, entitled "Corona Generating Device" in the name of Joan R. Ewing et al., filed Dec. 12, 1984; U.S. Ser. No. 680,861, entitled "Corona Generating Device" in the name of Robert P. Altavela et al., filed Dec. 12, 1984; U.S. Ser. No. 680,879, entitled "Corona Generating Device" in the name of Louis (NMI) Reale, filed Dec. 12, 1984; U.S. Ser. No. 703,971, entitled "Corona Generating Device" in the name of Louis (NMI) Reale, filed Feb. 18, 1985.

BACKGROUND OF THE INVENTION

The present invention relates generally to charging devices and in particular to charging devices which produce a negative corona.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

Various types of charging devices have been used to charge or precharge photoconductive insulating layers. In commercial use, for example, are various types of corona generating devices to which a high voltage of 5,000 to 8,000 volts may be applied to the corotron device thereby producing a corona spray which imparts electrostatic charge to the surface of the photoreceptor. One particular device would take the form of a single corona wire strung between insulating end blocks mounted on either end of a channel or shield. Another device, which is frequently used to provide more uniform charging and to prevent overcharging, is a scorotron which comprises two or more corona wires with a control grid or screen of parallel wires or apertures in a plate positioned between the corona wires and the photoconductor. A potential is applied to the control grid of the same polarity as the corona potential but with a much lower voltage, usually several hundred volts, which supresses the electric field between the charge plate and the corona wires and markedly reduces the ion current flow to the photorecepetor.

A recently developed corona charging device is described in U.S. Pat. No. 4,086,650 to Davis et al., commonly referred to in the art as a dicorotron wherein the corona discharge electrode is coated with a relatively thick dielectric material such as glass so as to substantially prevent the flow of conduction current therethrough. The delivery of charge to the photoconductive surface is accomplished by means of a displacement current or capacitive coupling through the dielectric material. The flow of charge to the surface to be charged is regulated by means of a DC bias applied to the corona shield. In operation an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and therefore does not have to be repeatedly cleaned.

In the dicorotron device described above the dielectric coated corona discharge electrode is a coated wire supported between insulating end blocks and the device has a conductive auxiliary DC electrode positioned opposite to the imaging surface on which the charge is to be placed. In the conventional corona discharge device, the conductive corona electrode is also in the form of an elongated wire connected to a corona generating power supply and supported by end blocks with the wire being partially surrounded by a conductive shield which is usually electrically grounded. The surface to be charged is spaced from the wire on the side opposite the shield and is mounted on a conductive substrate.

In addition to the desirability to negatively charge one type of photoreceptor it often is desired to provide a negative precharge to another type photoreceptor such as a selenium alloy prior to its being actually positively charged. A negative precharging is used to neutralize the positive charge remaining on the photoreceptor after transfer of the developed toner image to the copy sheet and cleaning to prepare the photoreceptor for the next copying cycle. Typically in such a precharge corotron an AC potential of between 4,500 and 6,000 volts rms at 400 to 600 Hz may be applied. A typical conventional corona discharge device of this type is shown generally in U.S. Pat. No. 2,836,725 in which a conductive corona electrode in the form of an elongated wire is connected to a corona generating AC voltage.

In the above referenced, copending applications, certain difficulties were observed when using corona charge devices that produced a negative corona. It is believed that various nitrogen oxide species are produced by the corona and that these nitrogen oxide species are adsorbed by solid surfaces. In particular it is believed that these oxide species are adsorbed by the conductive shield as well as the housing of the corona generating device. The shield may in principle be made from any conductor but is typically made from aluminum and the housing may be made from any of a number of structural plastics such as a glass filled polycarbonate. This adsorption of nitrogen oxide species occurs despite the fact that during operation the corona generating device may be provided with a directed air flow to remove the nitrogen oxide species as well as to remove ozone. In fact during the process of collecting ozone the air flow may direct the nitrogen oxide species to an affected area of the charging device or even some other machine part. It has also been found that after such exposure when a machine is turned off for extended periods of idleness that the adsorbed nitrogen oxide species gradually are desorbed, that is the adsorption is a physically reversible process. It should be understood that the adsorbed and desorbed species are both nitrogenous but not necessarily the same, i.e., there may be conversion of $NO_2$ to $HNO_3$. Then, when the operation of the machine is resumed, a copy quality defect is observed in the copies produced in that a line image deletion or lower density image is formed across the width of the photoreceptor at that portion of its surface which was at rest opposite the corona generating device during the period of idleness. While the mechanism of the interaction of the desorbed nitrogen oxide species and the photoreceptor layers is not fully understood, it is believed that they in some way interact with the surface of the photoreceptor increasing the lateral conductivity so that it cannot retain a charge in image fashion to be subsequently developed with toner. This basically causes narrow line images to blur or to wash out and not be developed as a toner image. This defect has been observed with conventional selenium photoreceptors which generally comprise a conductive drum substrate having a thin layer of selenium or alloy thereof vacuum deposited on its surface as the imaging surface. The difficulty is also perceived in photoreceptor configuration of plates, flexible belts, and the like, which may include one or more photoconductive layers in the supporting substrate. The supporting substrate may be conductive or may be coated with a conductive layer over which photoconductive layers may be coated. Alternatively, the multilayered electroconductive imaging photoreceptor may comprise at least two electrically operative layers, a photogenerating layer or a charge generating layer and a charge transport layer which are typically applied to the conductive layer. For further details of such a layer attention is directed to U.S. Pat. No. 4,265,990. In all these varying structures several of the layers may be applied with a vacuum deposition technique for very thin layers.

Furthermore with prolonged exposure of the photoreceptor to the desorbing nitrogen oxide species during extended periods of idleness the severity of the line defect or line spreading increases. While the mechanism is not fully understood it has been observed that even after a relatively short period of time, 15 minutes, and a period of idleness of, say, several hours, a mild line defect and concurrent image deletion may be perceived. During the initial stage of exposure of the photoreceptor to the desorbing nitrogen oxide species, it is possible to rejuvenate the photoreceptor by washing with alcohol since reaction between the photoreceptor and the nitrogen oxide species is purely at the surface. However after a prolonged period of time the reaction tends to penetrate the photoreceptor layer and cannot be washed off with the solvent. Thus, for example, the problem is perceived after a machine has been operated for about 10,000 copies, rested overnight and when the operator activates the machine the following morning, the line deletion defect will appear. As indicated above the defect is reversible to some degree by a rest period. However, the period involved may be of the order of several days which to an operator is objectionable.

Similar difficulties are encountered in a precharge corotron with a negative DC potential applied. Attempts to solve that problem by nickel plating the corotron shield met with limited success in that nickel combined with the nitrogen oxide species forming a nickel nitrate which is a deliquescent salt and on continued use becomes moist with water from the air eventually accumulating sufficient water that droplets may form and drop off onto the photoreceptor. Furthermore the nickel nitrate salts are green crystalline and loosely bonded rather than a cohesive durable film. In another attempt to solve a similar difficulty in a negative charging AC dicorotron device the shield is coated first with a layer of nickel that is subsequently plated with gold. However, as a result of the extreme expense of gold, the gold is plated in a very thin layer and consequently the layer is discontinuous having numerous pores in the layer. Gold plating is theorized to provide a relatively inert surface which will not adsorb the nitrogen oxide species or will not permit conversion to a damaging form. However with the thin porous layer of gold, the nickel substrate underneath the gold corrodes forming nickel nitrates in the same manner as with the precharge corotron and experiences similar difficulties resulting in limited useful life.

U.S. application Ser. No. 680,861 addresses this problem and provides a solution by means of plating the elements capable of absorbing nitrogen oxide species with a thin layer of lead. U.S. application Ser. No. 680,867 addresses the problem and teaches a remedy by providing continuous thin layer of a paint containing a reactive metal on the surfaces which absorbed the nitrogen oxide species. U.S. application Ser. No. 680,879 and U.S. application Ser. No. 703,971 addresses the problem and provide an alkali metal silicate coating on the elements capable of absorbing and neutralizing the nitrogen oxide species.

While capable of performing satisfactorily in the applications, according to the above reference copending applications, certain difficulties were observed with regard to use of alkali metal silicates as a coating on the conductive control grid in the above referenced type of scorotron charging device. In particular, it was observed that after about 8 hours use a white powder, presumably an alkali metal nitrate collected on the grid. The white powder on the grid was found to alter the electrostatic relationship in the charging devices in that the current delivered to the control grid from the coronodes and the current delivered to the photoreceptor began to vary uncontrollably thereby providing an unpredictable, uneven charge on the photoreceptor, resulting in poor copy quality. The exact mechanism by which this happens is not fully understood, but is believed to be a combination of the holes becoming clogged with the white powder, the resistive nature of the coating, and the particulate nature of the nitrate powder. In particular, the ratio of the current to the control grid to the photoreceptor is determined generally by the geometry of the control grid, so if the holes are plugged, that geometry and the ratio of the current to the grid to the photoreceptor is altered. The resistive nature of the nitrate powder causes it to change the effective bias on the grid by an amount equal to the voltage drop across the resistive powder layer. An finally, the particulate nature is believed to cause nonuniform electrical fields which in general tend to increase the current from the coronode.

PRIOR ART

Item No. 19957 in the Research Disclosure Journal of November 1980 at page 508 describes an electrophotographic copying machine having corona charging unit wherein the ions generated from the corona discharge can interact with the photoconductive member and the conductive housing to form salts, e.g. nitrates which during an overnight period of rest may have a detrimental effect on the part of the stationary photoconductive member opposite the opening to the corona charging unit. This detrimental effect is claimed to be overcome by coating the inner side of the housing with a cellulose acetate butyrate copolymer in which carbon black particles have been dispersed.

SUMMARY OF THE INVENTION

In accordance with the present invention a corona generating device for depositing a negative charge on an imaging surface is provided wherein the damaging nitrogen oxide species generated by the corona charging unit and adsorbed by at least one element of the corona charging device adjacent the corona discharge electrode during operation and desorbed when at rest, are neutralized.

In accordance with the principle aspect of the present invention the element which adsorbs and desorbs the nitrogen oxide species is coated with a substantially continuous thin conductive dry film of aluminum hydroxide to neturalize the nitrogen oxide species when they are generated.

In a further principle aspect of the present invention, the element whch adsorbes and desorbs the nitrogen oxide species comprises a conductive corona control grid of a scorotron charging device.

In a further aspect of the present invention the aluminum hydroxide film exists as the unhydrated oxide, a hydrated oxide, aluminum hydroxide or mixtures thereof.

In a further aspect of the present invention, the element which adsorbs and desorbs the nitrogen oxide species comprises a conductive shield which substantially surrounds the corona discharge electrode and has a longitudinal opening therein to permit ions emitted from the electrode to be directed toward the surface to be charged.

In a further aspect of the present invention, the corona discharge electrode comprises a thin wire coated at least in the discharge area with a dielectric material.

In a further aspect of the present invention, the corona generating device comprises a planar shield and includes an insulating housing having two sides adjacent such shield to define a longitudinal opening to permit ions emitted from the electrode to be directed toward the surface to be charged. The two sides of the insulating housing as well as a conductive shield are coated with a substantially continuous thin conductive dry film of aluminum hydroxide.

In a further aspect of the present invention, the aluminum hydroxide films are at least about 5 microns in thickness.

For a better understanding of the invention as well as other aspects and further features thereof, reference is had to the following drawings and descriptions.

DESCRIPTION OF THE PREFERRED EMBODIMENTS

Figure 1:
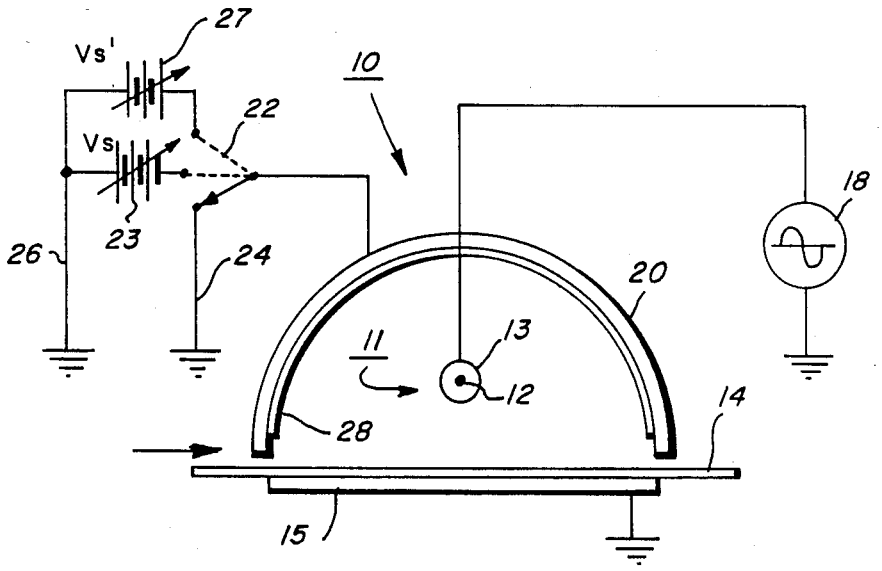
FIG. 1 is an illustrative cross section of a corona discharge device according to the present invention.

Referring to FIG. 1 the corona generator 10 of this invention is seen to comprise a corona discharge electrode 11 in the form of a conductive wire 12 having a relatively thick coating 13 of dielectric material.

A charge collecting surface 14 is shown which may be a photoconductive surface in a conventional xerographic systems. The charge collecting surface 14 is carried on a conductive substrate 15 held at a reference potential, usually machine ground. An AC voltage source 18 is connected between the substrate 15 and the corona wire 12, the magnitude of the AC source being selected to generate a corona discharge adjacent the wire 12. A conductive shield 20 is located adjacent the corona wire on the side of the wire opposite the chargeable surface.

The shield 20 has coupled thereto a switch 22 which depending on its position, permits the corona device to be operated in either a charge neutralizing mode or a charge deposition mode. With the switch 22 as shown, the shield 20 of the corona device is coupled to ground via a lead 24. In this position, no DC field is generated between the surface 14 and the shield 15 and the corona device operates to neutralize over a number of AC cycles any charge present on the surface 14.

With switch 22 in either of the positions shown by dotted lines, the shield is coupled to one terminal of a DC source 23 or 27, the other terminals of the sources being coupled to lead 26 to ground thereby establish a DC field between the surface 14 and the shield 20. In this position, the corona operates to deposit a net charge onto the surface 14, the polarity and magnitude of this charge depends on the polarity and magnitude of the DC bias applied to the shield 20.

The corona wire 13 may be supported in conventional fashion at the ends thereof by insulating end blocks (not shown) mounted within the ends of shield structure 20. The wire 12 may be made of any conventional conductive filament material such as stainless steel, gold, aluminum, copper, tungsten, platinum or the like. The diameter of the wire 11 is not critical and may vary typically between 0.5–15 mil. and preferably is about 9 mils.

Any suitable dielectric material may be employed as the coating 13 which will not break down under the applied corona AC voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating 13 used in the corona device of the invention is such that substantially on conduction current or DC charging current is permitted therethrough. Typically, the thickness is such that the combined wire and dielectric thickness falls in the range from 7–30 mil with typical dielectric thickness of 2–10 mil. Glasses with dielectric breakdown strengths above 2 KV/mil at 4 KHz and in the range of 2 to 5 mil thickness have been found by experiment to perform satisfactorily as the dielectric coating material. As the frequency or thickness go down the strength in volts per mil will usually increase. The glass coating selected should be free of voids and inclusions and make good contact with or wet the wire on which it is deposited. Other possible coatings are ceramic materials such as Alumina, Zirconia, Boron Nitride, Beryllium Oxide and Silicon Nitride. Organic dielectrics which are sufficiently stable in corona may also be used.

The frequency of the AC source 18 may be varied widely in the range from 60 Hz. commercial source to several megahertz. The device has been operated and tested at 4 KHz. and found to operate satisfactorily.

The shield 20 is shown as being semi-circular in shape but any of the conventional shapes used for corona shields in xerographic charging may be employed. In fact, the function of the shield 20 may be performed by any conductive member, for example, a base wire, in the vicinity of the wire, the precise location not being critical in order to obtain satisfactory operation of the device.

With the switch 22 connected as shown so that the shield 20 is grounded, the device operates to inherently neutralize any charge present on the surface 14. This is a result of the fact that no net DC charging current passes through the electrode 11 by virtue of the thick dielectric coating 13 and the wire 12.

Referring to FIG. 1, operation of the corona device of the invention to deposit a specific net charge on an imaging surface is accomplished by moving switch 22 to one of the positions shown in dotted lines, whereby a DC potential of either positive polarity or negative polarity with respect to the surface 15 may be applied to the shield.

In charging operation typical AC voltages applied to the corona electrodes are in the range from 4 KV to 7 KV at a frequency between 1 KHz and 10 KHz. With the conductive substrate of the imaging member being held at ground potential a negative DC bias of from about 800 volts to about 4 KV is applied to the shield. For further details of the manner of operation of the above described dicorotron device, attention is directed to U.S. Pat. No. 4,086,650 to Davis et al which is hereby incorporated in its entirety into the instant disclosure.

Referring once again to FIG. 1, the shield 20 is coated at least on its top with a substantially continuous thin conductive dry film 28 of aluminum hydroxide to neutralize the nitrogen oxide species that may be generated when a dicorotron is energized. The exact mechanism by which the aluminum hydroxide film neutralizes the nitrogen oxide species is not fully understood. However, it is believed that the aluminum hydroxide combines with the nitrogen oxide species to form an aluminum nitrate in an irreversible reaction but not white powder is observed. Such a mechanism would completely remove the possibility of exposure of the photoreceptor to the nitrogen oxide species. Since no white powder is observed it is believed that the reaction may take place slowly on a molecular scale which is not perceived by the unaided eye with the reaction products remaining dispersed in the original film. Furthermore, the adherent film formed on drying is believed to exist as the unhydrated aluminum oxide, a hydrated oxide or aluminum hydroxide or mixtures thereof. Preferably the aluminum hydroxide is applied to the surface or item to be coated in aqueous media providing a somewhat gelatinous coating which is subsequently readily dehydrated by driving off the water. The film forming properties may be improved by the addition of small amounts of water soluble binders such as polyvinylpyrollidone or polyvinyl alcohol. One percent by weight of solids may be adequate without imparing water resistance of the dry film. To impart the desired conductivity to the film, it also preferably contains a conductive non-reactive filler such as graphite when coated on the article to be coated. Reactive conductive fillers such as metallic particles are not preferred since they tend to react with the nitrogen oxide species forming nitrate powders.

Typical formulations to be applied to the article to be coated comprise aluminum oxide-hydrate and graphite in a weight ratio of about 1.5 to 2.2 dispersed in aqueous medium to provide from about 10% to 30% by weight solids. A particularly preferred formulation comprises by weight 77.5 percent water, about 14.5 percent aluminum oxide-hydrated and about 7 percent graphite and about 1% polyvinylpyrollidone and has a PH of 7. One way of characterizing the action of the aluminum oxide-hydrated is as an aluminum hydroxide which in the presence of nitrogen oxides acts as a base according to the following net reaction:

$$Al(OH)_3 + 1HNO_3 \rightarrow Al(OH)_2NO_3 + 1H_2O$$

In order to form the irreversible neutralization of the nitrogen oxides, the film should be sufficiently thick that it will not be consumed in a reasonable period of time thereby limiting the operation of the device. Accordingly it is preferred that the film be at least 5 microns in thickness to provide an acceptable operational life. Typically films are deposited in a thickness up to about a mil or more to insure that no nitrogen oxides are absorbed and subsequently desorbed by the shield, the film should be substantially continuous without pores.

The substantially continuous tin conductive dry film of aluminum hydroxide may be formed on the article to be coated by applying an aqueous solution or dispersion as a thin film thereto. Upon heating the liquid films dehydrate to provide a strong rigid inorganic adhesive bond to the substrate. Typically the films can be applied by spraying or brushing as with a paint so as to provide a coherent film on the shield.

Figure 2:
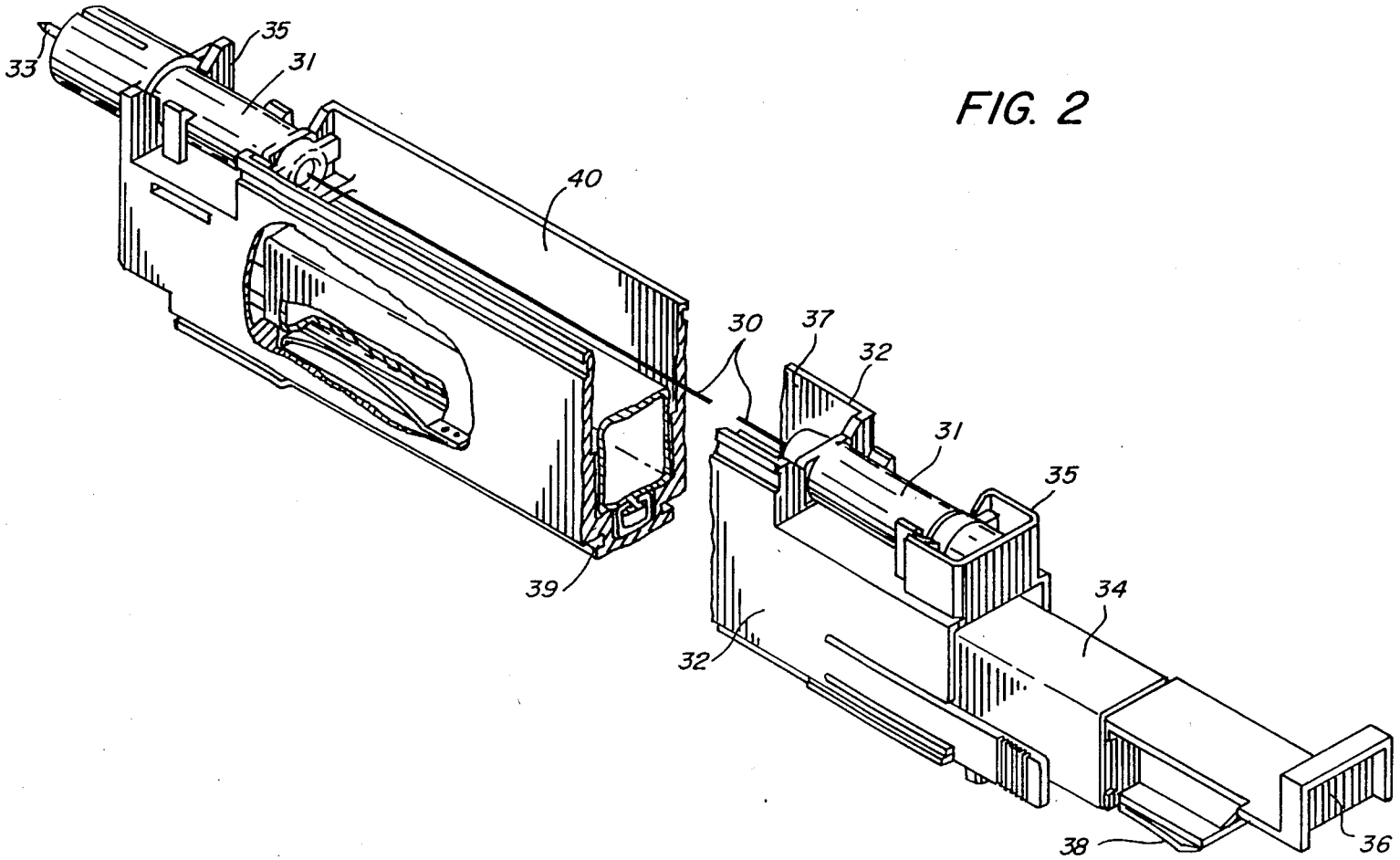
FIG. 2 is an isometric view of a preferred embodiment of a dicorotron according to the present invention.
Figure 3:
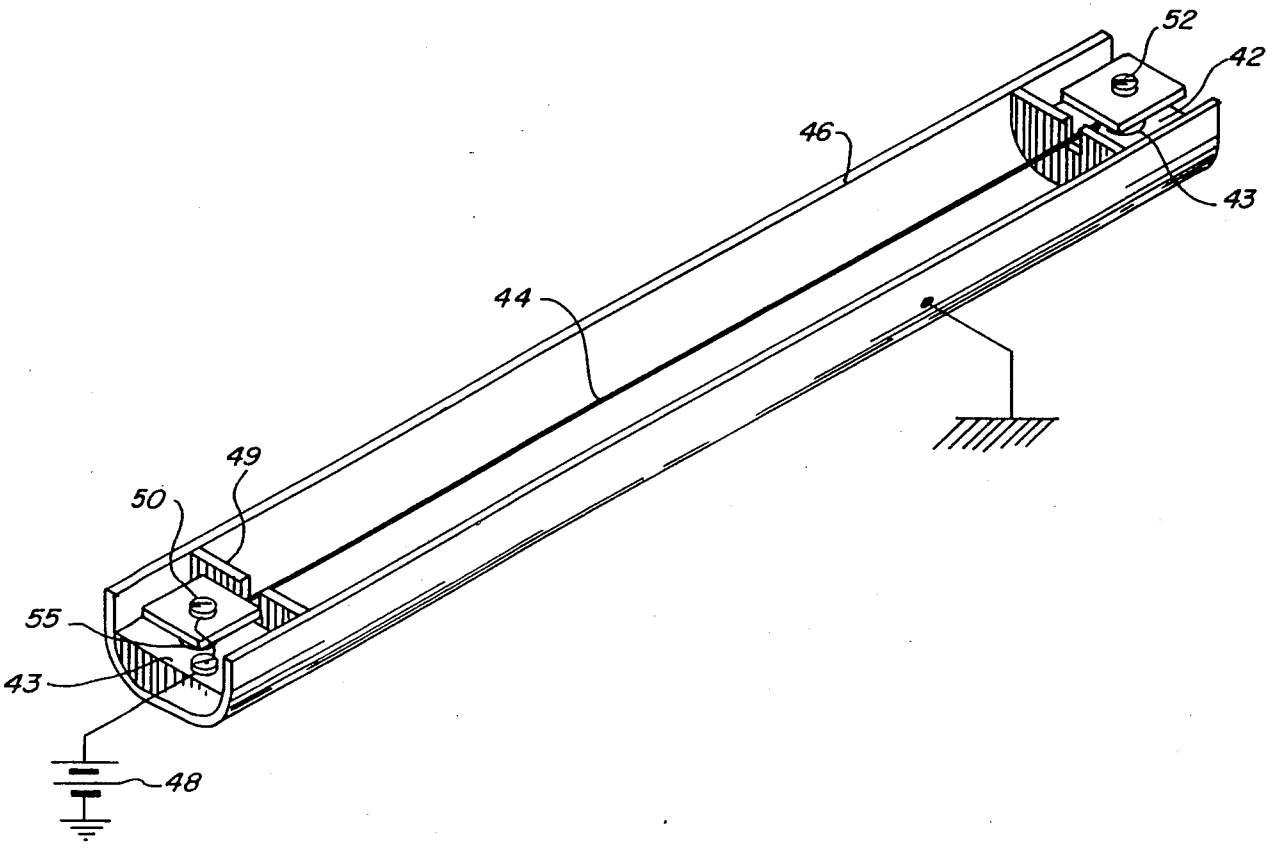
FIG. 3 is an isometric view of another preferred embodiment of a corotron according to the present invention.

FIG. 2 illustrates a preferred embodiment in the dicorotron device according to the present invention. In FIG. 2 the dicorotron wire 30 is supported between anchors 31 at opposite ends which are anchored in end blocks 35. The conductive shield 34 is constructed in tubular fashion in such a way as to be slideably mounted in the bottom of the housing 39 by means of handle 36. The shield is connected to the power supply through a sliding contact on its inner surface to a leaf spring which in turn is connected to a DC pin connector (not shown). The power supply potential may be positive, negative, or zero (grounded) depending on device function. It is fastened in place when inserted within the housing 39 by means of spring retaining member 38. When inserted in the machine high voltage contact pin 33 provides the necessary contact to the AC power supply. In addition to the conductive shield 34 the housing 39 comprises two vertically extending side panels 32 extending the entire length of the dicorotron wire. Both the top and inner surfaces of the shield 34 may have a substantially continuous thin conductive dry film of aluminum hydroxide. In addition, the vertically extending panels 32 of the housing 39 may also be coated with a substantially continuous thin conductive film 40 of aluminum hydroxide. The housing 39 together with the side panels 32 may be made from a single one piece molding from any suitable material such as glass filled polycarbonate.

Figure 4:
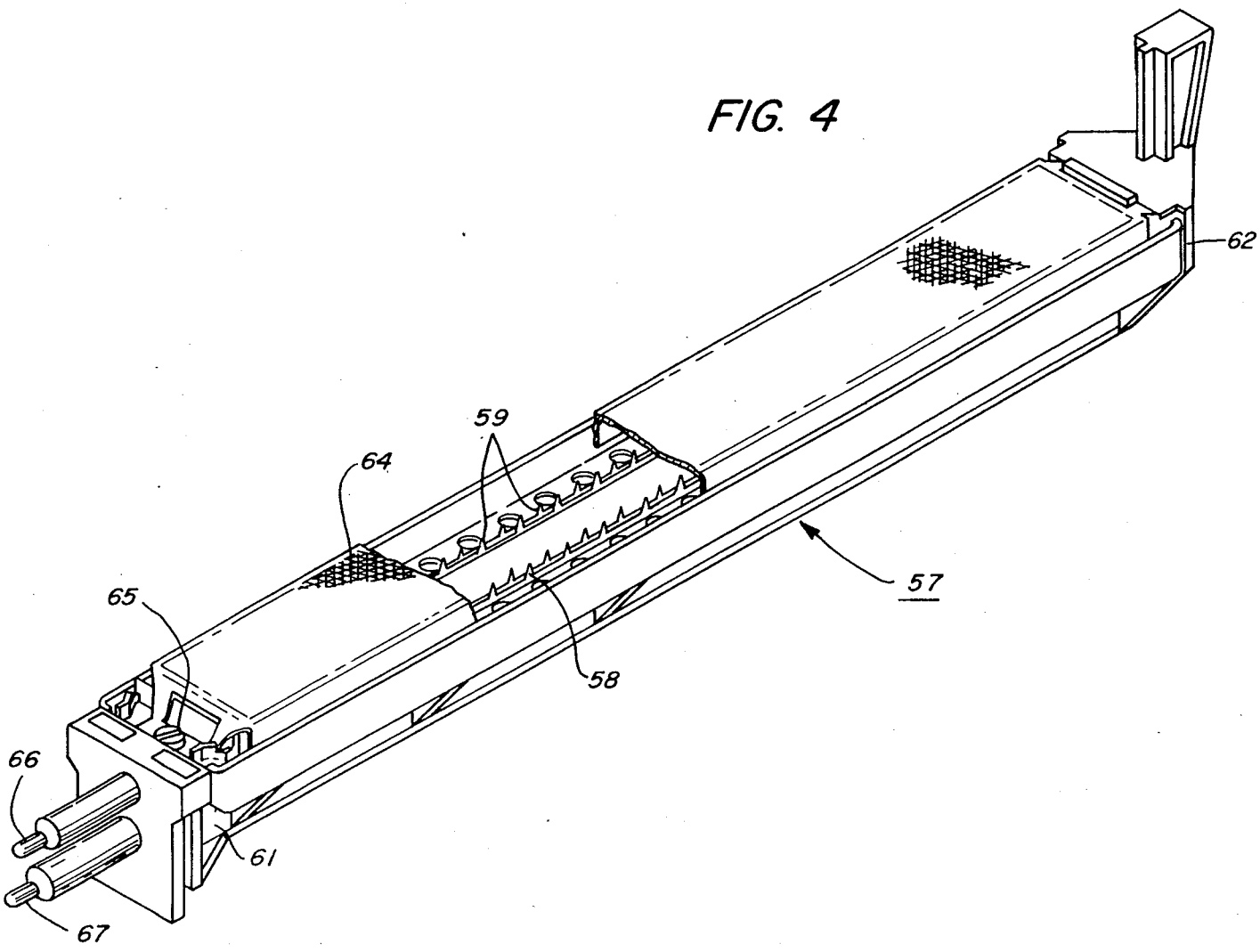
FIG. 4 is an isometric view of another preferred embodiment of a scorotron according to the present invention.
Figure 5:
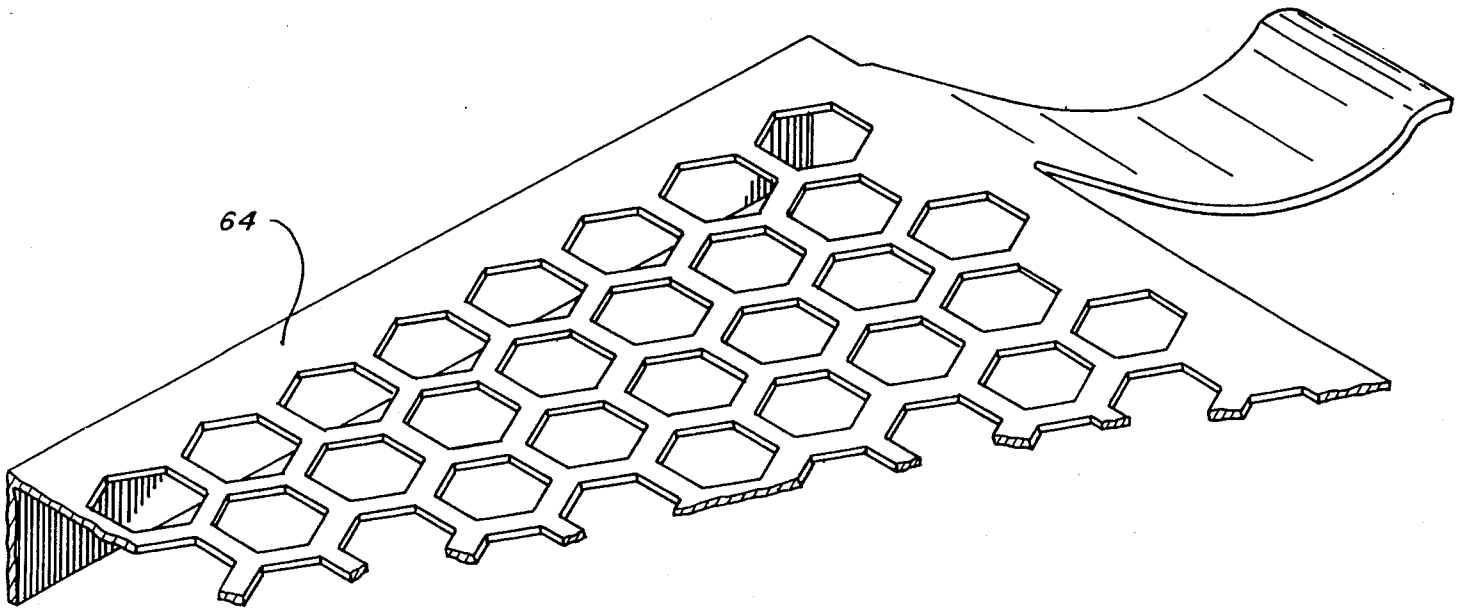
FIG. 5 is an enlarged view of the control grid used in the scorotron illustrated in FIG. 4.

FIGS. 4 and 5 illustrate alternative preferred embodiments according to the present invention which embody use of the present invention in coating the conductive corona control grid of a scorotron. In FIG. 4, scorotron 57 is represented as including two linear pin electrode arrays 58, and 59 supported between insulating end block assemblies 61 and 62. The conductive corona control grid 64 is placed on top of the linear pin arrays and anchored in place by means of screw 65 to potential generating source by lead 66. Both of the linear pin electrode arrays 58 and 59 are connected to potential generating source 67. Such a device might have utility as a negative charging corona generating device wherein the potential from a high voltage DC power supply applied to the grid is about −800 volts or very close to the voltage desired on the imaging surface which is closely spaced therefrom. The potential applied to the two linear pin electrode arrays is in the range of from about −6,000 to about −8,000 volts. The entire assembly is supported by being clamped between three injection molded plastic support strips. In this configuration the two linear pin coronodes in the shape of a saw tooth provide vertically directional fields and currents due to their geometry providing a higher efficiency of current to the photoconductor versus the total current generated. The grid acts as a leveling device or reference potential limiting the potential on the substrate being charged. In accordance with the present invention, the grid may be coated with a substantially continuous thin conductive dry film of aluminum hydroxide.

To test the efficiency of the substantially continuous thin conductive dry films of aluminum hydroxide according to the present invention, a strip of aluminum, half of which is coated with an aluminum hydroxide film according to the present invention and half of which was not coated with the aluminum hydroxide film, was placed over the elongated slot of the illustrated dicorotron charging device and actuated for about 15 hours overnight. The coated portion of the aluminum strip was coated with Electrodag 121 an aqueous dispersion of semicolloidal graphite in an organic binder which cures at 350° C. in one hour to form a hard conductive coating and which is available from Acheson Colloid Company, Port Huron, Mich. The dispersion which is believed to contain 77.5 percent by weight water, 14.5 percent aluminum oxide hydrated and 7 percent by weight graphite and about 1% by weight polyvinylpyrollidone is applied by spraying both sides of the corona control grid. The next morning the aluminum plate was placed parallel to and about 3 millimeters away from a negative charged photoreceptor belt for about 1 hour and subsequently removed. Thereafter, the photoreceptor was charged with a corotron having an applied voltage of about +5 KV and scanned across its surface with an electrometer so that it would scan both the areas adjacent to the portion of the belt exposed to both the coated and uncoated aluminum plate. On the piece opposite the coated plate the photoreceptor had been charged to a potential of about +800 volts. On the portion of the photoreceptor opposite the uncoated aluminum plate substantially no charge was present as determined by the electrometer.

Further testing was conducted with the same scorotron charging device as illustrated in FIG. 4 in a machine fixture having the Electrodag 121 coating described above. After over 185,000 copies no white deposit was observed and the copies produced no signs of the deletion difficulty previously mentioned. By contrast, in the same test fixture with a scorotron having the corona control grid uncoated, deletions were observed after 25,000 copies and rust was observed on the corona control grid.

As pointed out above, the negative charging devices according to the present invention have the advantage of successfully neutralizing nitrogen oxides formed during the charging operation. While it is not fully understood, it is believed that the aluminum hydroxide combines in some form with the nitrogen oxide species in an irreversible action forming aluminum nitrates. Further these coatings have the distinct advantage of being readily commercially available in aqueous solution and may be applied by simple brushing, spraying or dipping techniques without the use of extensive and expensive equipment. In addition they provide durable corrosion resistant, water resistant, adherent coatings on the surface to which they are applied. They thereby provide efficient long life coatings on charging devices which are aesthetically pleasing in that they do not wet or turn a different color. Finally, they are very good film formers.

All the patents and the article referred to herein are hereby incorporated by reference in their entirety to the instant specification.

While the invention has been described with reference to the specific embodiments it will be apparent to those skilled in the art that many alternatives, modifications and variations may be made. It is intended to embrase such modifications and alternatives as may fall within the spirit and scope of the appended claims.

What is claimed is:

1. A corona generating device for depositing a negative charge on an imaging surface carried on a conductive substrate held at a reference potential comprising;

at least one elongated conductive corona discharge electrode supported between insulating end blocks, means to connect said electrode to a corona generating potential source, at least one element adjacent said corona discharge electrode capable of adsorbing nitrogen oxide species generated when said corona discharge electrode is energized and capable of desorbing nitrogen oxide species when said electrode is not energized, said at least one element being coated with a substantially continuous tin conductive dry film of aluminum hydroxide to neutralize the nitrogen oxide species when generated.

2. The corona generating device of claim 1, wherein said film is at least about 5 microns is thickness.

3. The corona generating device of claim 1, wherein the aluminum hydroxide film exists as the unhydrated oxide, a hydrated oxide, aluminum hydroxide or mixtures thereof.

4. The corona generating device of claim 1, wherein said at least one element comprises a conductive shield which substantially surrounds said corona discharge electrode and has a longitudinal opening therein to permit ions emitted from the electrode to be directed toward the surface to be charged.

5. The corona generating device of claim 4, wherein said corona discharge electrode comprises a thin wire coated at least in the discharge area with a dielectric material, and said conductive shield has means associated therewith to connect to a potential source.

6. The corona generating device of claim 4, wherein said shield is planar on one side of the corona discharge electrode and further including an insulating housing having two sides adjacent said shield to define a longitudinal opening to permit ions emitted from the electrode to be directed toward a surface to be charged, said two sides of said insulating housing being coated with a substantially continuous thin conductive dry aluminum hydroxide.

7. The corona generating device of claim 5, wherein said dielectric material is glass.

8. The corona generating device of claim 1, wherein said at least one elongated conductive corona discharge electrode comprises at least one linear array of pin electrodes.

9. The corona generating device of claim 8, wherein said at least one element comprises a conductive corona control grid.

10. The corona generating device of claim 1, wherein said film contains an amount of conductive particulate material to render the film conductive.

* * * * *